United States Patent [19]

Matsumoto et al.

[11] 4,330,198

[45] May 18, 1982

[54] MAGNETIC BRUSH DEVELOPING DEVICE FOR ELECTROSTATIC COPYING APPARATUS

[75] Inventors: Joji Matsumoto, Neyagawa; Yuji Hasegawa, Nishinomiya, both of Japan

[73] Assignee: Mita Industrial Company Limited, Osaka, Japan

[21] Appl. No.: 175,861

[22] Filed: Aug. 6, 1980

[30] Foreign Application Priority Data

Aug. 7, 1979 [JP] Japan ..... 54-100947

[51] Int. Cl.[3] ..... G03G 15/00

[52] U.S. Cl. ..... 355/14 D; 118/657

[58] Field of Search ..... 355/3 DD, 14 D; 118/657, 658

[56] References Cited

U.S. PATENT DOCUMENTS

| | | | |
|---|---|---|---|
| 3,811,766 | 5/1974 | Robinson | 355/3 DD |
| 3,906,897 | 9/1975 | Davidson | 118/658 X |
| 3,942,474 | 3/1976 | Smith et al. | 118/657 |
| 4,077,358 | 3/1978 | Kito | 118/658 |

OTHER PUBLICATIONS

*Research Disclosure,* "Magnetic Brush Development Apparatus", No. 14362, Mar. 1976, pp. 40,41.

*Primary Examiner*—Richard L. Moses

*Attorney, Agent, or Firm*—Wenderoth, Lind & Ponack

[57] ABSTRACT

A magnetic brush developing device for an electrostatic copying apparatus wherein a magnetic brush is formed on a surface of a developing roller includes a magnet roller rotating inside of a cylindrical sleeve which is located adjacent to the surface of an electrostatic latent image retaining member to which a developing material is circumferentially applied. The magnet roller stops at a rotary angle such that a bristle of the magnetic brush on the sleeve is spaced from the surface of the electrostatic latent image retaining member, whereby a bristle of the magnetic brush is prevented from remaining in contact with the electrostatic latent image retaining member. Thereby, the developing material is prevented from causing the surface of the electrostatic latent image retaining member to change chemically, the developing material is prevented from causing the electrical characteristics of the surface to fail, and the developing material is prevented from adhering to the surface.

5 Claims, 11 Drawing Figures micro switch
copy paper discharge detecting means
magnetic solenoid optical sensor
copy paper discharge detecting means
driving means
52
45
53
54
3
1
2
14
12
9
13
17
47
46
49
48
52
51
50

MAGNETIC BRUSH DEVELOPING DEVICE FOR ELECTROSTATIC COPYING APPARATUS

BACKGROUND OF THE INVENTION

1. Field of the Invention

The present invention relates to a magnetic brush developing device to be used in an electrostatic copying apparatus or a facsimile apparatus.

2. Description of the Prior Art

In a conventional electrostatic copying apparatus, a magnetic brush developing device is generally used for developing an electrostatic latent image on a photosensitive member to be used as an electrostatic latent image retaining member a hollow developing roller provided with a magnet roller therein is positioned adjacent to the photosensitive member. A magnetic brush is formed on the surface of the developing roller, and the electrostatic latent image on the photosensitive member is developed visibly by friction with the magnetic brush. In accordance with the conventional magnetic brush developing device as described above, when the magnetic roller stops the magnetic brush which is formed on the surface of the developing roller remains to contact with the photosensitive member, the and developing material adheres mechanically to the surface of the photosensitive member or the surface to be developed. Therefore it is difficult to remove the developing material adhering on the surface of the photosensitive member. Especially, the developing material for pressure fixing has a strong tendency to adhere. Since the surface to be developed is covered with the developing material, i.e. a chemical substance, the surface is subject to chemical change of failure of electrical characteristics.

It is an object of the invention to provide a magnetic brush developing device for solving the technical problems above-mentioned.

A more particular object of the invention is to provide a new and improved magnetic brush developing device to prevent the surface to be developed from changing chemically, or to prevent electrical characteristics of the surface to be developed from failing due to the developing material.

SUMMARY OF THE INVENTION

To accomplish the foregoing objectives, there is provided a magnetic brush developing device for an electrostatic copying apparatus wherein a magnetic brush is formed on a surface of a developing roller. The device includes a magnet roller rotating inside of a cylindrical sleeve located adjacent to the surface of an electrostatic latent image retaining member. A developing material is circumferentially applied characterized in that the magnetic roller stops at an angle of rotation such that a bristle of the magnetic brush on the sleeve is spaced from the surface of the electrostatic latent image retaining member.

Since the magnet roller stops at a rotary position such that a low bristle of the magnetic brush is spaced from the surface of the electrostatic latent image retaining member, a bristle of the magnetic brush is prevented from remaining in contact with the electrostatic latent image retaining member. Thereby, the developing material is prevented from causing the surface of the electrostatic latent image retaining member to change chemically, the developing material is prevented from causing the electrical characteristics of the surface to fail, and the developing material is prevented from adhering to the surface.

In a preferred embodiment, the magnet roller is connected to driving means via a one-way clutch, and a magnetic permeable member is fixed closely adjacent to the end of the developing roller.

The magnetic brush developing device is implemented by (a) means for detecting the rotary position of the magnet roller, and (b) detecting means operable in response to a detecting output for setting the rotary position of the magnet roller such so that a low bristle of the magnetic brush on the sleeve is spaced toward the surface of the electrostatic latent image retaining member. The detecting means comprises magnet detecting means arranged adjacent to the developing roller. The magnet roller is connected to driving means, and the magnet roller is stopped from rotating when the rotary position detecting means detects a rotary position such that a low bristle of the magnetic brush on the sleeve is spaced from the surface of the electrostatic latent image retaining member after completion of a recording step.

According to one aspect of the invention, the detecting means comprises (a) a cam geared with the magnet roller for rotation, and (b) a switch whose switching state is alternated by the cam when the magnet roller reaches a rotary position such that a low bristle of the magnetic brush is spaced from the surface of the electrostatic latent image retaining member.

In another preferred embodiment, the detecting means comprises (a) a rotary member geared with the magnet roller and provided with a first optically detected position at a position corresponding to the rotary position whereat a low bristle of the magnetic brush is spaced from the surface of the electrostatic latent image retaining member and another optically detected position differing from the first optically detected position at the circumferential remaining portion of the member, and (b) optical detecting means for detecting one of the optically detected positions.

In still another embodiment, the detecting means of the magnet roller comprises (a) a one-way clutch arranged between the magnet roller and the driving means for transmitting rotary torque from the driving means to the magnet roller, (b) auxiliary driving means for setting the rotary position of the magnet roller, and (c) another one-way clutch arranged between the magnet roller and the auxiliary driving means which rotates slower than the driving means and in the same direction as the driving means.

In a preferred embodiment, the detecting means of the magnet roller comprises (a) an input member having a boss which is idly held to a rotary shaft fixed to the magnet roller and extending along the rotary shaft, and being connected to the driving means, (b) a boss member fixed on the rotary shaft and facing to the boss, (c) a ratchet wheel surrounding the boss and the boss member, and having a tooth to prevent the rotary shaft from rotating, (d) a spring tightening around the boss and the boss member in the rotational direction of the magnetic roller, one end of the spring being connected to the boss member and the other to the ratchet wheel, (e) the tooth being engageable with the ratchet wheel, and (f) magnetic means for driving to rotate so as to cause the tooth to engage with the ratchet wheel.

BRIEF DESCRIPTION OF THE DRAWINGS

A detailed description of the invention now will be made with reference to the accompanying drawings wherein like numerals designate corresponding parts in the various figures and wherein.

DETAILED DESCRIPTION OF THE PREFERRED EMBODIMENTS

The invention will be further understood from the following description and the accompanying drawings of illustrative embodiments thereof.

Figure 1:
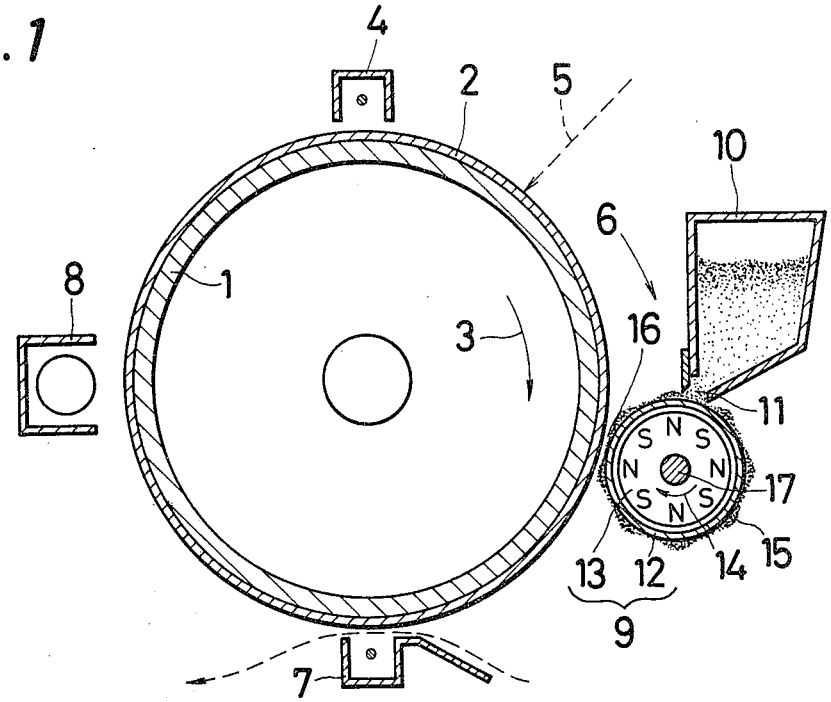
FIG. 1 is a schematic cross sectional view according to one preferred embodiment of the invention.

FIG. 1 is a schematic cross sectional view according to an embodiment of the invention. A cylindrical drum 1, whose outer periphery is coated with a photosensitive member 2 as an electrostatic latent image retaining member, is driven to rotate during copying. The drum 1 rotates in the direction indicated by an arrow 3. A corona charger 4, exposure means 5, a magnetic brush developing device 6 also performing a cleaning function, a transfer corona charger 7 and a charge erasing lamp 8 are closely placed sequentially in the rotational direction 3 over the periphery of the drum 1.

The electrostatic copying apparatus completes a cycle of a recording step (a cycle of a copying step in association with a copying apparatus,) when the drum 1 is rotated two times on recording and a copy paper is discharged. The photosensitive member 2 is charged by the corona charger 4 on the first rotation of the drum 1 and the photosensitive member 2. The exposure means 5 projects a light image corresponding to an original document onto the charged surface of the photosensitive member 2, and forms an electrostatic latent image on the photosensitive member 2. The developing device 6 applies one-component developing material or dual-component developing material over the surface of the photosensitive member 2, and thereby develops visibly the electrostatic latent image. The visible toner image is transferred onto a copy paper by means of a charge by the transfer corona charger 7, which copy paper is transported as indicated by a dotted arrow in FIG. 1, synchronzation with rotation of the drum 2 in the rotational direction 3. Thereafter, the transferred copy paper is transported to a fixing device (not shown) to be fixed and is discharged.

Residual electric charge over the surface of the photosensitive member 2 rotated in the rotational direction 3 from the transfer corona charger 7 is erased by a charge erasing lamp 8. Sequentially residual toner remaining on the photosensitive member 2 is cleaned by the developing means 6 during the second rotation of the drum 1.

Figure 2:
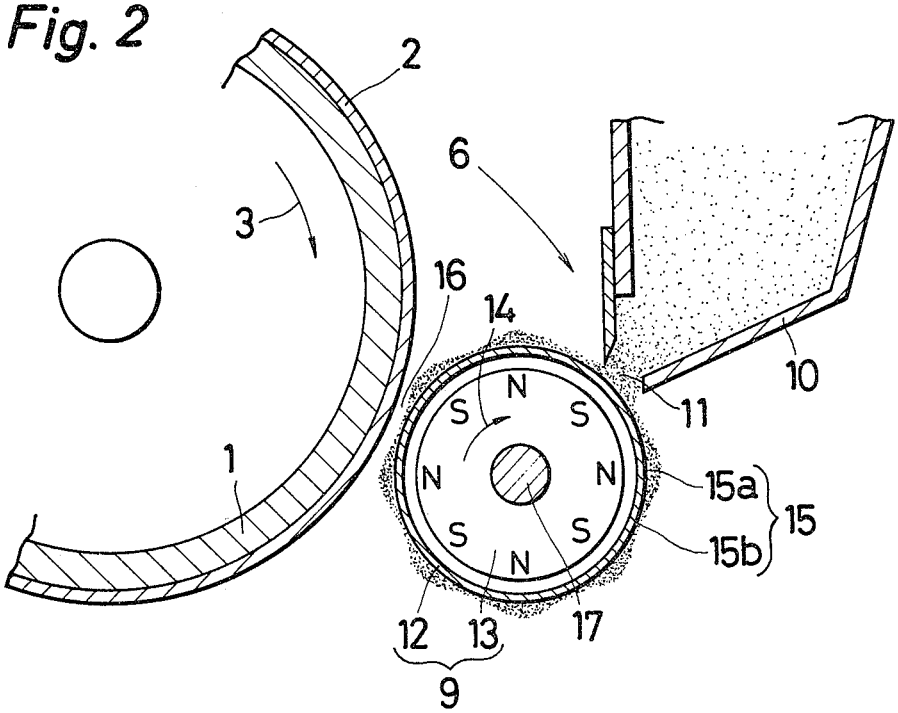
FIG. 2 is an enlarged cross sectional view in the vicinity of the developing device of FIG. 1.

FIG. 2 is an enlarged cross sectional view in the vicinity of the developing device 6 shown in FIG. 1. The developing device 6 comprises a developing roller 9 with a rotary axis parallel with the axis of the drum 1 and a sump 10 for storing the developing material and having an opening 11. The developing roller 9 includes a stationary sleeve 12 fixed in the vicinity of the photosensitive member 2 and a magnet roller 13 which is coaxially and rotatably supported in the sleeve 12. The magnet roller 13, whose outer periphery is magnetically charged so that a plurality of magnetic N poles alternate with S poles at regular intervals, is coupled to a rotary shaft 17. The magnet roller 13 has eight-pole as shown in FIG. 2 or twelve-poles. When the magnet roller 13 is driven to rotate in the direction indicated by an arrow 14, a magnetic brush 15 is formed circumferentially on the surface of the sleeve 12. The magnetic brush 15 is composed of convex parts 15*a* that form high magnetic bristles at the magnetic N poles and S poles, and concave parts 15*b* that form circumferentially a low magnetic bristle between convex parts 15*a*. The magnetic brush 15 rotates reversely on the sleeve 12 corresponding to the magnet roller 13 rotating in the direction of arrow 14. The electrostatic latent image on the photosensitive member 2 is developed by friction with the magnetic brush 15 at a developing zone 16.

Figure 3:
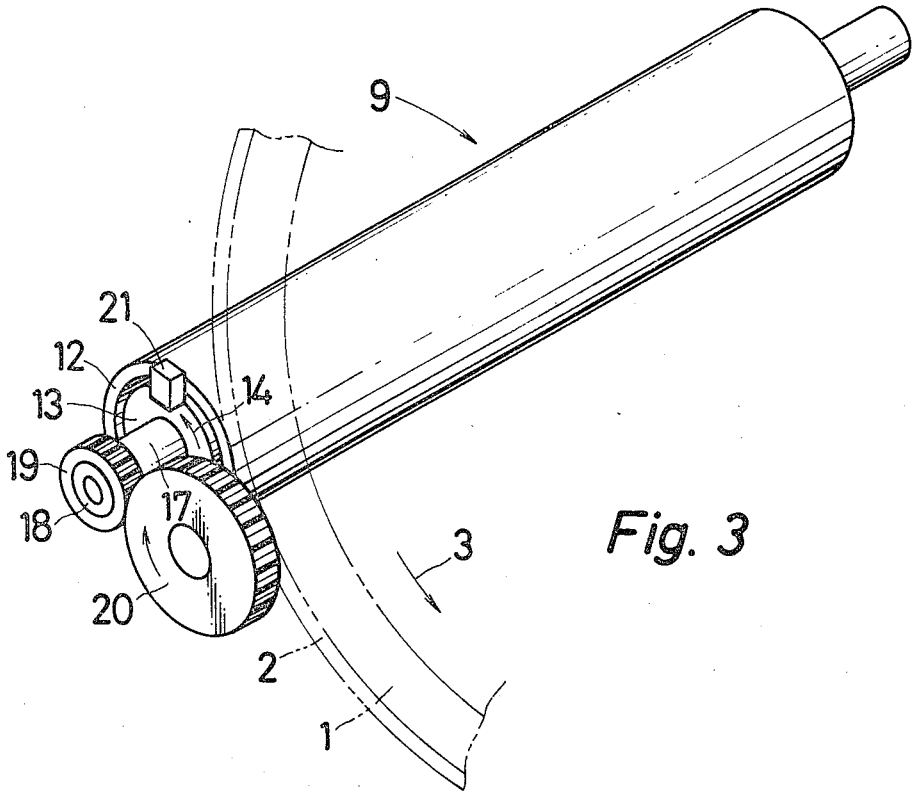
FIG. 3 is a simplified perspective view in the vicinity of the developing roller of FIG. 1 as observed from the rear side of the electrostatic copying apparatus.

FIG. 3 is a simplified perspective view in the vicinity of the developing roller 9 as observed from the rear side of the electrostatic copying apparatus. The end of the rotary shaft 17 of the magnet roller 13 is provided with a gear 19 through an one-way clutch 18. The gear 19 is connected to driving means (not shown) through a gear 20 in order to proceed during a copying step of the electrostatic copying apparatus. Therefore the rotary shaft 17 is driven to rotate in the direction of arrow 14 when the driving means is actuated, and the rotary shaft 17 comes to a standstill when the driving means is deactivated. Though rotational torque of the gear 19 is transmitted to the rotary shaft 17 by means of the one-way clutch 18, rotational torque of the rotary shaft 17 is never transmitted to the gear 19. A magnetic permeable member, for example a steel plate 21, is fixed adjacent to the end of the magnet roller 13, and is fixed to a frame of the copying apparatus (not shown).

Figure 4:
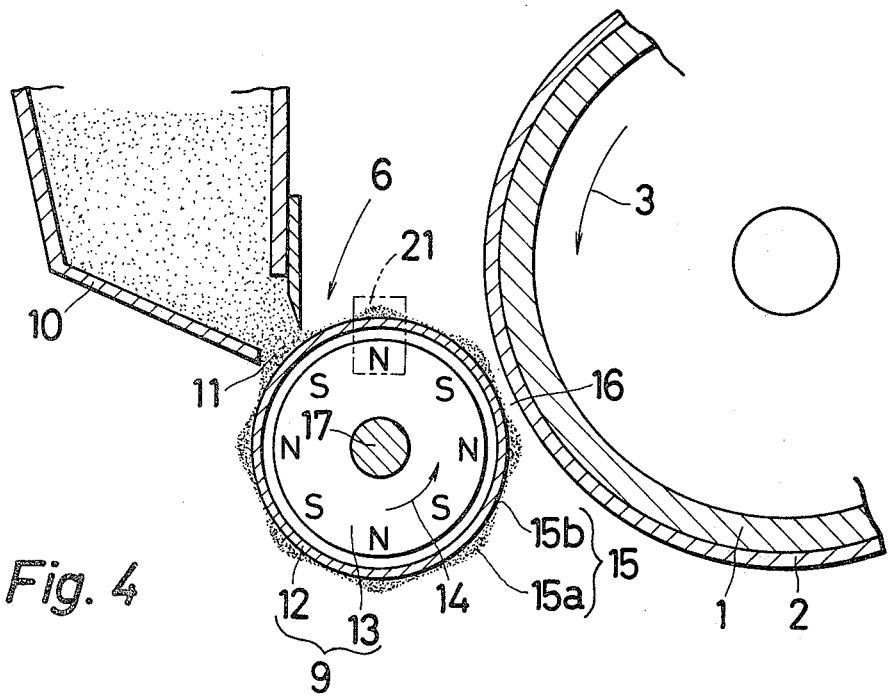
FIG. 4 is a cross sectional view in the vicinity of the developing device as observed from the rear side of the electrostatic copying apparatus.

FIG. 4 is a cross sectional view in the vicinity of the developing device 6 as observed from the rear side of the copying apparatus. Assume that the drum 1, the gears 19 and 20 stop rotating when the driving means is stopped after completion of a copying step. Then the magnet roller 13 is freely rotatable in the direction of arrow 14 by means of the one-way clutch 18. Since an N pole or an S pole of the magnet roller 13 is attracted to the steel plate 21 such, N pole or S pole is rotated to a location where either pole is positioned at the steel plate 21. The steel plate 21 is fixed at a location such that a concave part 15*b* of the magnetic brush 15 will then be at the developing zone 16. Therefore a bristle of the magnetic brush 15 is prevented from remaining in contact with the photosensitive member 2 when the magnet roller 13 stops rotating.

The steel plate 21 may be positioned adjacent to the circumference of the sleeve 12. A magnetic plate which does not damage the developing material may replace the steel plate 21.

Figure 5:
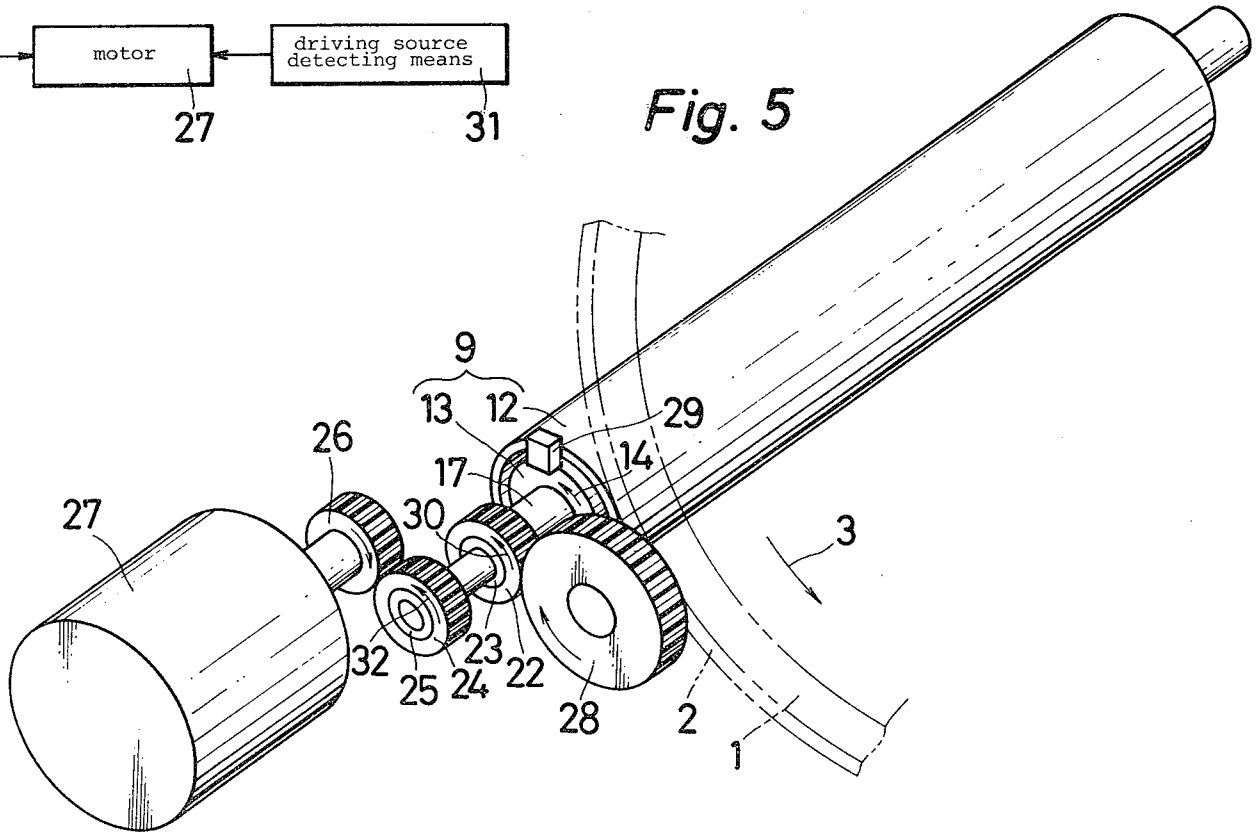
FIG. 5 is a simplified perspective view according to another embodiment of the invention.

FIG. 5 is a perspective view according to another embodiment similar to FIG. 3, and constructions corresponding to the embodiment of the invention shown in FIG. 1 to FIG. 4 are illustrated by the same reference numerals. The end of the rotary shaft 17 of the magnet roller 13 is provided with a gear 22 through a one-way clutch 23, and is coaxially provided with another gear 24 through a one-way clutch 25. The gear 22 meshes with a gear 28 connected to the driving means of the copying apparatus, and the gear 24 meshes with a gear 26 connected to the output shaft of a motor 27 as an auxiliary driving means which is driven for setting a rotary angle or position of the magnet roller 13. A magnetic sensor 29 is disposed adjacent to the end of the magnet roller 13.

When the driving means is actuated on during copying, rotational torque of the gear 22, which meshes with the gear 28, rotating in the direction of an arrow 30 is transmitted to the rotary shaft 17 via the one-way clutch 23, and sequentially the magnet roller 13 is driven to rotate in the direction of arrow 14. During this time rotational torque of the rotary shaft 17 is not transmitted to the gear 24 by means of the one-way clutch 25, and the gear 24 remains stationary.

Figure 6:
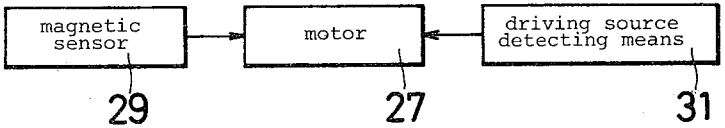
FIG. 6 is a wiring diagram of the electric circuit included the motor and the magnetic sensor shown in FIG. 5.

Assume that the driving means of the copying apparatus is stopped after completion of a copying step. As soon as the gears 28 and 22 stop rotating, motor 27 is supplied with a signal from a driving source detecting means 31 and commences rotating. Accordingly, rotational torque of the gear 24 rotating in the direction of an arrow 32 via the gear 26 is transmitted to the rotary shaft 17 via the one-way clutch 25, and the magnet roller 13 is driven to rotate in the direction of arrow 14. Since rotational torque of the rotary shaft 17 is never transmitted to the gear 22 by means of the one-way clutch 23, the gear 22 remains stationary. When the magnet roller 13 is driven to rotate and a magnetic N pole or S pole is detected by the magnetic sensor 29, the motor 27 receives a signal from the magnetic sensor 29 as shown in FIG. 6 and is stopped from further rotation. The magnetic sensor 29 is disposed so that at this time a concave part 15*b* (refer to FIG. 4) of the magnetic brush 15 will be positioned at the developing zone 16. A bristle of the magnetic brush 15 thus is prevented from remaining in contact with the photosensitive member 2.

Figures 7, 8, 9:
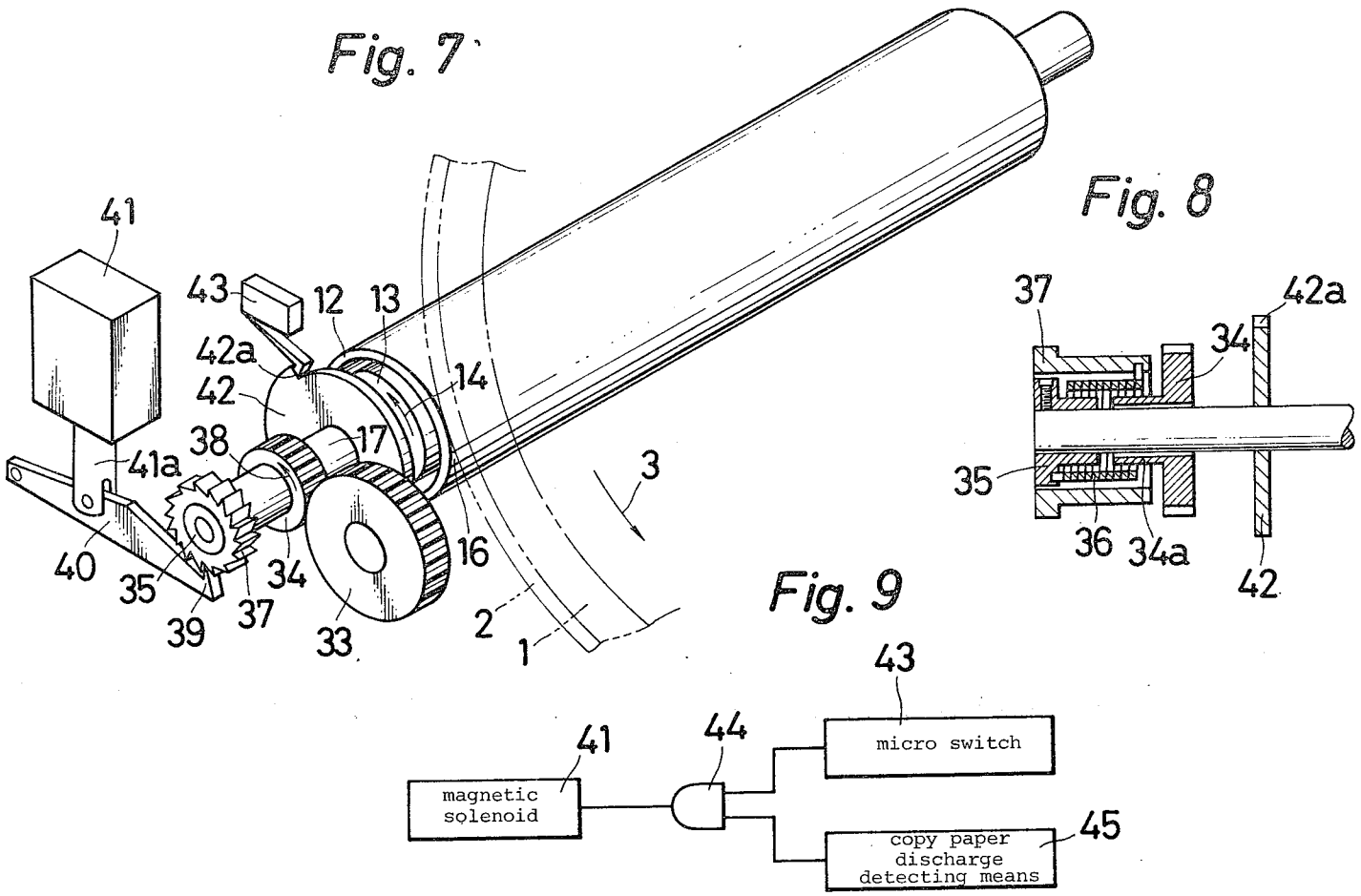
FIG. 7 is a simplified perspective view according to a further embodiment of the invention.
FIG. 8 is a cross sectional view in the vicinity of the end of the rotary shaft shown in FIG. 7.
FIG. 9 is a wiring diagram of the electric circuit included the magnetic solenoid and the micro switch.

FIG. 7 is a simplified perspective view according to a further embodiment of the invention shown in FIG. 3. FIG. 8 is a cross sectional view in the vicinity of the end of the rotary shaft 17 shown in FIG. 7, and constructions corresponding to the embodiment of the invention as shown in FIG. 1 to FIG. 4 are illustrated by the same reference numerals. A gear 34 which meshes with a gear 33 connected to a driving means (not shown) is loosely inserted onto the end of the rotary shaft 17. A boss 34*a* of the gear 34 extends along the rotary shaft 17, and a boss member 35 extending toward the boss 34*a* is fixed to the rotary shaft 17. A spring 36 is fitted around the boss 34*a* and the boss member 35, and a ratchet wheel 37 is further arranged around the spring 36. When the spring 36 is tightened in the direction of an arrow 38 as shown in FIG. 7, the spring 36 operates in a direction for fastening the boss 34*a* and the boss member 35. One end of the spring 36 is connected to the boss member 35, and the other end of spring 36 is connected to the ratchet wheel 37. The ratchet wheel 37 and the spring 36 compose a wrap spring clutch. One end of a lever 40 is provided with a tooth 39 which engages with the ratchet wheel 37 and the other end of lever 40 is supported by a pin. The middle portion of the lever 40 is connected to a plunger 41*a* which is movable by means of magnetic means such as a magnetic solenoid 41. Since the tooth 39 remains unengaged with the ratchet wheel 37 in the non exciting state of the magnetic solenoid 41, rotational torque of the gear 34 is transmitted to the rotary shaft 17. When the magnetic solenoid 41 is excited, the tooth 39 is engaged with the ratchet wheel 37, the gear 34 runs idle around the rotary shaft 17 and rotational torque of the gear 34 is never transmitted to the rotary shaft 17. A cam plate 42 is fixed to the rotary shaft 17. A depressed portion 42*a* is arranged at the outer periphery of the cam plate 42 so as to detect the rotary position or angle of rotation of the rotary shaft 17. A micro switch 43 is actuated by means of with the depressed portion 42*a*. The micro switch 43 is disposed so that a concave part 15*b* (refer to FIG. 4) of the magnetic brush 15 is positioned at the developing zone 16 when micro switch 43 is closed by the depressed portion 42*a*.

FIG. 9 is a wiring diagram of the electric circuit for exciting magnetic solenoid 41. One input terminal of an AND gate 44 is connected to the micro switch 43, and the other input terminal is connected to detecting means for detecting completion of a copying step, for example means 45 for detecting a copy paper discharge operation. An output terminal of the AND gate 44 is connected to the magnetic solenoid 41. The copy paper discharge detecting means 45 detects completion of a copying step and then the magnetic solenoid 41 is excited when the micro switch 43 contacts with the depressed portion 42*a* of the cam plate 42 and is closed. Accordingly the tooth 39 engages with the ratchet wheel 37. Since rotational torque of the gear 34 rotating in the direction of arrow 38 is never transmitted to the rotary shaft 17, the magnet roller 13 stops rotating. Then a concave part 15*b* (refer to FIG. 4) of the magnetic brush 15 is positioned at the developing zone 16. Therefore a bristle of the magnetic brush 15 is prevented from remaining in contact with the photosensitive member 2.

Figures 10, 11:
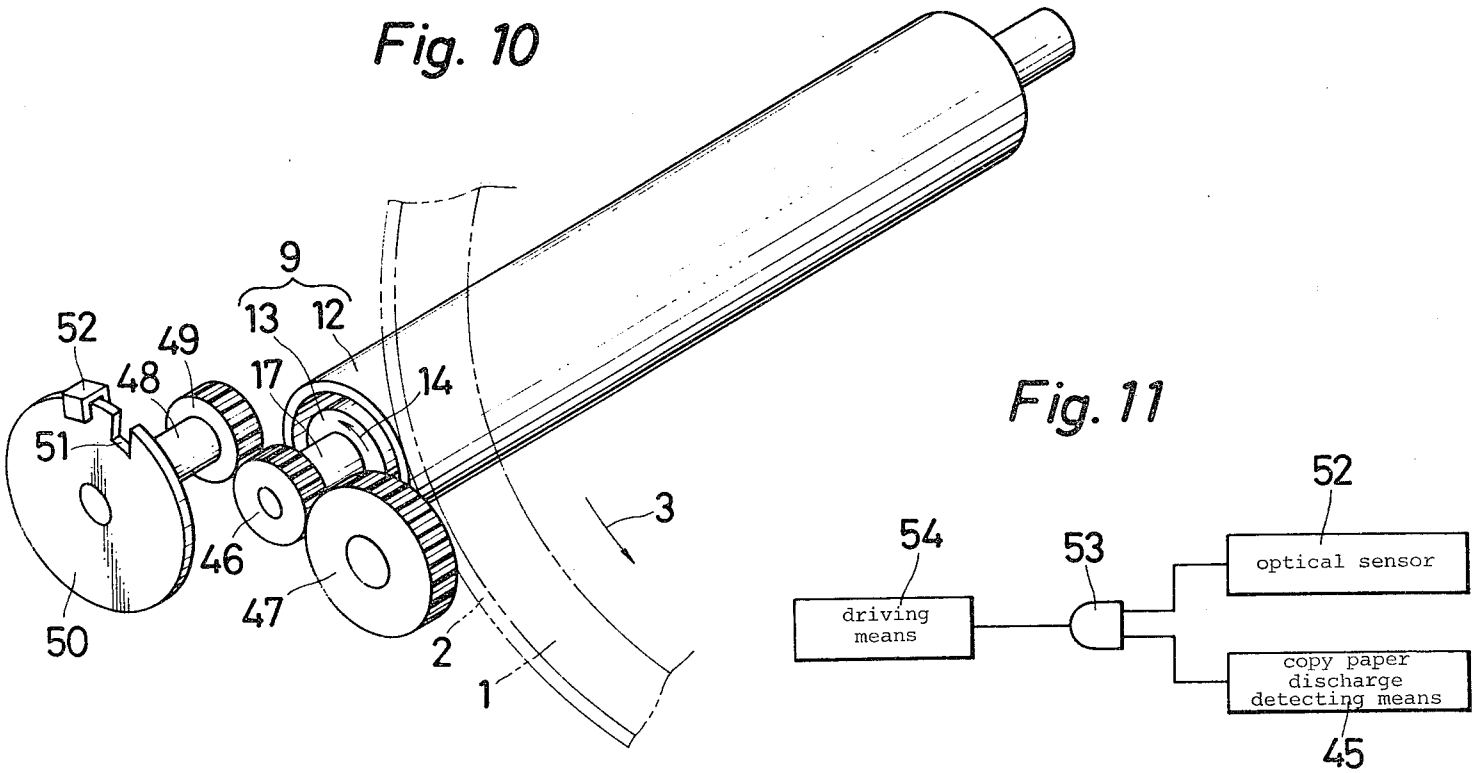
FIG. 10 is a simplified perspective view according to a still further embodiment of the invention.
FIG. 11 is a wiring diagram of the electric circuit included the optical sensor shown in FIG. 10.

FIG. 10 is a simplified perspective view according to a still further embodiment of the invention and the same constructions as those of the embodiment of the present invention shown in FIG. 1 to FIG. 4 are illustrated by the same reference numerals. A gear 46 fixed with one end of the rotary shaft 17 is connected to driving means (not shown) through a gear 47. The gear 46 is connected to a gear 49 fixed to one end of a shaft 48 parallel with the rotary shaft 17. A circular plate 50 having a notch 51 arranged on the circumference thereof is fixed with the other end of the shaft 48. An optical sensor 52, such as an optical detecting means for detecting the notch 51, is provided. The optical sensor 52, which includes a light generating element and a receiving element facing each other at opposite sides of the circular plate 50, is disposed so that a concave part 15*b* (refer to FIG. 4) of the magnetic brush 15 is positioned at the developing zone 16 when the optical sensor 52 detects the notch 51.

Referring to FIG. 11, an input terminal of an AND gate 53 is connected to optical sensor 52 and the other input terminal is connected to the copy paper discharge detecting means 45. An output terminal of the AND gate 53 is coupled to driving means 54 connected to the gear 47. After completion of a copying step, when the copy paper discharge detecting means 45 provides a signal to the AND gate 53 and the optical sensor 52 detects the notch 51, the driving means 54 stops rotating by means of an output signal from the AND gate 53. Accordingly the gear 46 and the rotary shaft 17 is stopped. Consequently the magnet roller 13 stops rotating. Since the concave part 15*b* of the magnetic brush 15 is positioned at the developing zone 16, a bristle of the magnetic brush is prevented from remaining is contact with the photosensitive member 2.

In each embodiment of the invention as above-mentioned, when the rotary shaft 17 is still rotating with inertial force even though the driving means 54 is stopped, the magnetic sensor 29, the micro switch 43 and the optical sensor 52 are disposed at positions to bring into consideration such inertia. A friction brake may be provided so as to reduce the rotational force of the rotary shaft 17 as soon as possible. An endless belt whose outer periphery is coated with a photosensitive member may replace the cylindrical drum. This invention may be used not only for embodiments of an electrostatic copying apparatus as above-mentioned but also for a device which records an electrostatic latent image on a recording paper sheet as an electrostatic latent image retaining member such as a facsimile.

What is claimed is:

1. A magnetic brush developing device for use in applying a developing material circumferentially to an electrostatic latent image retaining member of an electrostatic copying apparatus, said device comprising:

developing roller means for forming on a surface thereof a magnetic brush formed of developing material and including circumferentially alternate high bristle portions and low bristle portions, said developing roller means comprising a cylindrical sleeve receiving on the outer surface thereof said magnetic brush and adapted to be positioned adjacent to a surface of an electrostatic latent image retaining member of an electrostatic copying apparatus at a developing zone, and a magnet roller rotatably mounted within said cylindrical sleeve for, upon rotation of said magnet roller, causing said high and low bristle portions of said magnetic brush to pass alternately through said developing zone and to apply said developing material to the surface of the electrostatic latent image retaining member;

driving means;

one-way clutch means for transmitting rotation to said magnet roller from said driving means; and means for, upon stopping of said driving means, causing said magnetic roller to stop at a rotational position thereof such that a said low bristle portion of said magnetic brush is at said developing zone and is spaced from the surface of the electrostatic latent image retaining member, said means comprising a magnetic permeable member fixed adjacent to an end of said developing roller means.

2. A magnetic brush developing device for use in applying a developing material circumferentially to an electrostatic latent image retaining member of an electrostatic copying apparatus, said device comprising:

developing roller means for forming on a surface thereof a magnetic brush formed of developing material and including circumferentially alternate high bristle portions and low bristle portions, said developing roller means comprising a cylindrical sleeve receiving on the outer surface thereof said magnetic brush and adapted to be positioned adjacent to a surface of an electrostatic latent image retaining member of an electrostatic copying apparatus at a developing zone, and a magnet roller rotatably mounted within said cylindrical sleeve for, upon rotation of said magnet roller, causing said high and low bristle portions of said magnetic brush to pass alternately through said developing zone and to apply said developing material to the surface of the electrostatic latent image retaining member;

a cam mounted for rotation with said magnet roller, said cam having a surface portion representative of a rotational position of said magnet roller whereat a said low bristle portion of said magnetic brush is at said developing zone and is spaced from the surface of the electrostatic latent image retaining member;

switch means positioned to detect said surface portion of said cam and for generating a signal representative thereof; and means operable in response to receipt of said signal for interrupting rotation of said magnet roller, such that when said magnet roller is stopped the said low bristle portion of said magnetic brush will be spaced from the surface of the electrostatic latent image retaining member.

3. A magnetic brush developing device for use in applying a developing material circumferentially to an electrostatic latent image retaining member of an electrostatic copying apparatus, said device comprising:

developing roller means for forming on a surface thereof a magnetic brush formed of developing material and including circumferentially alternate high bristle portions and low bristle portions, said developing roller means comprising a cylindrical sleeve receiving on the outer surface thereof said magnetic brush and adapted to be positioned adjacent to a surface of an electrostatic latent image retaining member of an electrostatic copying apparatus at a developing zone, and a magnet roller rotatably mounted within said cylindrical sleeve for, upon rotation of said magnet roller, causing said high and low bristle portions of said magnetic brush to pass alternately through said developing zone and to apply said developing material to the surface of the electrostatic latent image retaining member;

a rotary member mounted for rotation with said magnet roller, said rotary member including a first optically detectable portion representative of a rotational position of said magnet roller whereat a said low bristle portion of said magnetic brush is at said developing zone and is spaced from the surface of the electrostatic latent image retaining member, and said rotary member including a second optically detectable portion different from said first optically detectable portion;

optical detecting means for detecting said first and second portions of said rotary member and for generating a signal condition upon detection of said first portion; and means operable in response to receipt of said signal condition for interrupting rotation of said magnet roller, such that when the magnet roller is stopped the said low bristle portion of said magnetic brush will be spaced from the surface of the electrostatic latent image retaining member.

4. A magnetic brush developing device for use in applying a developing material circumferentially to an electrostatic latent image retaining member of an electrostatic copying apparatus, said device comprising:

developing roller means for forming on a surface thereof a magnetic brush formed of developing material and including circumferentially alternate high bristle portions and low bristle portions, said developing roller means comprising a cylindrical sleeve receiving on the outer surface thereof said magnetic brush and adapted to be positioned adjacent to a surface of an electrostatic latent image retaining member of an electrostatic copying apparatus at a developing zone, and a magnet roller rotatably mounted within said cylindrical sleeve for, upon rotation of said magnet roller, causing said high and low bristle portions of said magnetic brush to pass alternately through said developing zone and to apply said developing material to the surface of the electrostatic latent image retaining member;

main driving means;

first one-way clutch means for transmitting rotation to said magnet roller from said main driving means;

auxiliary driving means operable only when said main driving means is stopped;

second one-way clutch means for transmitting rotation to said magnet roller from said auxiliary driving means; and magnet detecting means, operatively connected to said auxiliary driving means, for, when said main driving means is stopped, detecting a rotational position of said magnet roller whereat a said low bristle portion of said magnetic brush is at said developing zone and is spaced from the surface of the electrostatic latent image retaining member, and for stopping said auxiliary driving means such that said magnet roller is stopped at said rotational position thereof.

5. A magnetic brush developing device for use in applying a developing material circumferentially to an electrostatic latent image retaining member of an electrostatic copying apparatus, said device comprising:

developing roller means for forming on a surface thereof a magnetic brush formed of developing material and including circumferentially alternate high bristle portions and low bristle portions, said developing roller means comprising a cylindrical sleeve receiving on the outer surface thereof said magnetic brush and adapted to be positioned adjacent to a surface of an electrostatic latent image retaining member of an electrostatic copying apparatus at a developing zone, and a magnet roller rotatably mounted within said cylindrical sleeve for, upon rotation of said magnet roller, causing said high and low bristle portions of said magnetic brush to pass alternately through said developing zone and to apply said developing material to the surface of the electrostatic latent image retaining member;

a rotary shaft fixed to said magnetic roller;

driving means;

an input member loosely fitted over said rotary shaft, said input member receiving rotation from said driving means, said input member having extending therefrom a boss;

a boss member fixed to said rotary shaft and extending toward said boss;

a ratchet wheel surrounding said boss and said boss member;

spring means, having a first end connected to said boss member and a second end connected to said ratchet wheel, for tightening on said boss and said boss member and for enabling rotation of said input member from said driving means to be transmitted to said rotary shaft and said magnet roller;

a tooth mounted for movement between a first position out of engagement with said ratchet wheel and a second position in engagement with said ratchet wheel whereat transmission of said rotation to said rotary shaft and said magnet roller is interrupted;

means for detecting a rotational position of said magnet roller whereat a said low bristle portion of said magnetic brush is at said developing zone and is spaced from the surface of the electrostatic latent image receiving member and for generating a signal representative thereof; and means operable in response to receipt of said signal for moving said tooth to said second position thereof, such that said magnet roller is stopped with the said low bristle portion of said magnetic brush spaced from the surface of the electrostatic latent image retaining member.

* * * * *